US005989367A

United States Patent [19]

Zeuner et al.

[11] Patent Number: 5,989,367

[45] Date of Patent: Nov. 23, 1999

[54] PARTICLE-FREE, GAS-PRODUCING MIXTURE

[75] Inventors: Siegfried Zeuner, München; Achim Hofmann, Polling; Roland Schropp, Tegernheim; Karl-Heinz Rödig, Kraiburg, all of Germany

[73] Assignee: TRW Airbag Systems GmbH & Co. KG, Aschau/Inn, Germany

[21] Appl. No.: 09/159,917

[22] Filed: Sep. 24, 1998

[30] Foreign Application Priority Data

Sep. 24, 1997 [DE] Germany ..... 197 42 203

[51] Int. Cl.[6] ..... C06B 31/32; C06B 47/08; C06B 29/22

[52] U.S. Cl. ..... 149/47; 149/36; 149/76

[58] Field of Search ..... 149/47, 46, 36, 149/76

[56] References Cited

U.S. PATENT DOCUMENTS

| | | | |
|---|---|---|---|
| 3,708,357 | 1/1973 | Morrow . | |
| 4,111,728 | 9/1978 | Ramnarace . | |
| 4,355,577 | 10/1982 | Ady et al. . | |
| 4,552,597 | 11/1985 | Abegg et al. | 149/2 |
| 4,604,151 | 8/1986 | Knowlton et al. . | |
| 5,531,941 | 7/1996 | Poole | 264/3.4 |
| 5,545,272 | 8/1996 | Poole et al. . | |
| 5,773,754 | 6/1998 | Yamato | 149/36 |
| 5,780,768 | 7/1998 | Knowlton et al. | 149/36 |

FOREIGN PATENT DOCUMENTS

| | | |
|---|---|---|
| 0659712 | 6/1995 | European Pat. Off. . |
| 0801045 | 10/1997 | European Pat. Off. . |
| 4435523 | 6/1996 | Germany . |
| 19505568 | 8/1996 | Germany . |
| 4435524 | 8/1996 | Germany . |
| 19531130 | 2/1997 | Germany . |
| 9504710 | 2/1995 | WIPO . |

OTHER PUBLICATIONS

6001 Chemical Abstracts, 115 (1991) Dec. 2, No. 22, Columbus, Ohio, U.S. 115: 235783q *Combustion mechanism of GAB/AN propellants.*

*Primary Examiner*—Charles T. Jordan
*Assistant Examiner*—Aileen J. Baker
*Attorney, Agent, or Firm*—Tarolli, Sundheim, Covell, Tummino & Szabo L.L.P.

[57] ABSTRACT

The invention relates to a particle-free, gas-producing mixture for use in a gas generator for a safety device, in particular for a vehicle-occupant restraint system, with a total water content of the gas-producing mixture of at most 0.3%, consisting of:

a) an energy-rich fuel with an oxygen value of not less than −35%;

b) an oxidant mixture of ammonium nitrate and ammonium perchlorate, wherein the ammonium nitrate is contained in a proportion of 35 to 50 wt. %, and the ammonium perchlorate in a proportion of 3 to 10 wt. %, in each case relative to the total weight of the mixture;

c) optionally, relative to the total weight of the mixture, a phase-stabilizing additive for the ammonium nitrate in a proportion of at most 5 wt. % relative to the weight of the ammonium nitrate;

d) 0 to 3 wt. % combustion moderators relative to the total weight of the mixture, and e) 0 to 5 wt. % processing aids relative to the total weight of the mixture.

13 Claims, No Drawings

PARTICLE-FREE, GAS-PRODUCING MIXTURE

The invention relates to a particle-free, gas-producing mixture for use in gas generators for safety devices, in particular in gas generators for vehicle-occupant restraint systems.

BACKGROUND OF THE INVENTION

Gas generators for safety devices usually contain a solid propellant on the basis of sodium azide as a gas-yielding main constituent. However, sodium azide is toxic and can easily react with heavy metals to form extremely dangerous, violently reacting compounds. Therefore, special measures are necessary both during the preparation of the gas-producing mixtures and during the disposal of defective or unused gas generators.

The combustion of sodium-azide-containing propellants also produces a number of solid substances which have to be removed from the gas stream by means of suitable filtering devices in the gas generator, or have to be retained in the gas generator. Therefore, attempts have already been made to produce propellants which burn off in a substantially residue-free manner.

U.S. Pat. No. 5,545,272 describes a gas-producing composition substantially consisting of 35 to 55 wt. % nitroguanidine and approximately 45 to 65 wt. % phase-stabilised ammonium nitrate. The addition of phase-stabilising agents to the ammonium nitrate is considered necessary because a structural change, occurring in pure ammonium nitrate at 32.3° C., is linked with an increase in volume which, according to the aforementioned patent specification, is to be prevented. Potassium salts such as potassium nitrate and potassium perchlorate, but also potassium dichromate, potassium oxalate and mixtures thereof in a quantity of 5 to approximately 25 wt. %, preferably 10 to 15%, are named as phase-stabilising additives.

However, the gas-producing composition of U.S. Pat. No. 5,545,272 cannot burn off residue-free, i.e. without solid combustion residues, on account of the relatively high proportion of phase-stabilising additives for the ammonium nitrate. Consequently, the combustion of this propellant gives rise to smoke formation which can only be partially suppressed by filtering devices in the gas generator. Furthermore, the known mixture is only poorly ignitable and has a relatively low rate of combustion. Moreover, the high proportion of ammonium nitrate leads to high hygroscopicity, necessitating a high level of expenditure for processing, storage and use in the gas generator in order to prevent unwanted changes occurring in the propellant mixture.

DE 195 05 568 A1 discloses a propellant for gas generators, comprising, as fuel, at least one compound from the group of tetrazoles, triazoles, triazines, cyanic acid, urea, derivatives thereof, derivatives or salts thereof, and, as oxidants, at least three compounds from the group of peroxides, nitrates, chlorates or perchlorates, as well as combustion moderators and additions reducing the proportion of toxic gases. Biuret, guanidine, nitroguanidine, guanidine nitrate, aminoguanidine, aminoguanidine nitrate, thiourea and triaminoguanidine nitrate can be used as urea derivatives. Ammonium nitrate or ammonium perchlorate, among others, are named independently of one another as oxidants. However, DE 195 05 568 A1 contains no indication of the proportion of solid substances in the gas mixture released after the combustion of the propellants.

Therefore, there is still a need for gas-generator propellants which burn off in a residue-free manner, are non-toxic, i.e. are free of azides and heavy metals, burn off with a hundred percent gas yield to form a particle-free, non-toxic combustion gas, and have a sufficiently high rate of combustion and good thermal and chemical stability.

SUMMARY OF THE INVENTION

The invention provides an azide-free, gas-generating mixture burning off in a particle-free manner for use in a gas generator for a safety device, consisting of an energy-rich fuel with an oxygen value of not less than −35%, an oxidant mixture of ammonium nitrate and ammonium perchlorate with an ammonium nitrate proportion of 35 to 50 wt. % and an ammonium perchlorate proportion of between 3 and 10 wt. %, in each case relative to the total weight of the mixture, optionally a phase-stabilising additive for the ammonium nitrate in a proportion of at most 5 wt. % relative to the weight of the ammonium nitrate, combustion moderators in a proportion of 0 to 3 wt. % relative to the total weight of the mixture, and processing aids in a proportion of 0 to 5 wt. % relative to the total weight, of the mixture. The total water content of the gas-producing mixture is at most 0.3%. The ammonium nitrate proportion is preferably between 40 and 50%, more preferably between 40 and 45%. The ammonium perchlorate proportion is preferably in the range between 3 and 7 wt. %.

The energy-rich fuel is preferably selected from the group comprising guanidine nitrate, nitroguanidine, triaminoguanidine nitrate, urea nitrate, nitrourea, pentaerythritol tetranitrate, nitrotriazolon, hexogen, octogen or mixtures thereof. The fuel guanidine nitrate and/or nitroguanidine is especially preferred. The latter is the most preferred fuel.

The ammonium nitrate used according to the invention can contain small quantities of phase-stabilising additives for increasing storage stability which are selected from the group comprising copper oxide, zinc oxide, complex zinc compounds or mixtures thereof. It has emerged that, in contrast to the potassium compounds required in quantities of 10 to 15% for phase stabilisation in U.S. Pat. No. 5,545,272, at most 5% of the named additives are required for the use according to the invention. Surprisingly, it has been found that, with simultaneous control of the water content of the total mixture, the proportion of phase-stabilising additives can be reduced to nil. Whereas, with a water content of 0.1 to 0.3%, phase-stabilising additives of 3 to 5% are used to ensure storage stability, phase-stabilising additives can be entirely omitted with a water content of less than 0.1 %. Overall, this results in a 50 to 100% reduction of the solids emissions by the mixture according to the invention in relation to U.S. Pat. No. 5,545,272.

The compounds known in the art can be used as a combustion moderator. These include transition-metal compounds and soot. The transition-metal compounds can be selected from the group of transition-metal oxides, hydroxides, nitrates, carbonates and organo-metallic compounds of the transition metals. Examples of these are iron oxides, copper oxides, chromium oxides, zinc oxide, copper chromite, basic copper nitrate, zinc carbonate, copper resorcylate and ferrocene. However, the use of soot as a combustion moderator, optionally in a mixture with transition-metal compounds, is preferred since soot is inexpensive and it burns off residue-free, forming $CO_2$.

Finally, processing aids can also be added to the gas-producing mixture in a known manner and are selected from the group comprising the compression aids, flowing aids or lubricants. Examples of such processing aids are polyethylene glycol, cellulose, methyl cellulose, graphite, wax, magnesium stearate, zinc stearate, boron nitride, talcum, bentonite, silicon dioxide or molybdenum sulphide.

The ammonium nitrate proportion according to the invention of less than 50 wt. %, preferably less than 45%, ensures that the unfavourable properties, e.g. low structural stability, hygroscopicity, poor ignitability and low rate of combustion of ammonium-nitrate-containing mixtures, can be compensated for by the addition of ammonium perchlorate. However, with an ammonium perchlorate proportion of less than 3%, there is no substantial improvement with respect to the ignitability and rate of combustion of the propellant. An ammonium perchlorate proportion of more than 10 wt. % leads to the formation of free hydrogen chloride, which is undesirable for occupant protection systems on account of the strict toxicity requirements placed on propellant gases. Surprisingly, it has been found that ae use of ammonium perchlorate in proportions between 3 and 10 wt. % in practice does not lead to the formation of hydrogen chloride, or the hydrogen chloride concentration in the gas mixture is substantially lower than according to theoretical calculations, presumably due to absorption effects or condensation with water vapour. The gas-producing mixture according to the invention can therefore be classified as physiologically harmless.

Additionally, however, the use of ammonium perchlorate, even in the small proportion of 3 to 10 wt. %, leads to a substantial increase in ignitability and rate of combustion of the propellant according to the invention. Moreover, owing to the relatively high oxygen content of ammonium perchlorate, the ammonium nitrate proportion in the mixture can be more greatly reduced.

The invention therefore provides a gas-producing mixture which burns off with a gas yield of up to one hundred percent and from which a substantially particle-free gas mixture is released and which is physiologically harmless. The use of an oxidant mixture of ammonium nitrate and ammonium perchlorate additionally ensures good ignitability and a high rate of combustion. At the same time, the mixture according to the invention has high thermal and chemical stability.

DESCRIPTION OF PREFERRED EMBODIMENTS

The invention will be described in the following with reference to preferred embodiments which are not, however, to be regarded as limiting.

EXAMPLE 1

51.5 g dry nitroguanidine, 43.0 g dry ammonium nitrate, 5.0 g dry ammonium perchlorate and 0.5 g soot were homogenised together in a ball mill and then compressed to form propellant tablets. The tablets thus produced were ignited in a gas generator. The combustion pressure attained in the gas generator was 350 bar, and the combustion duration was in the region of 30 ms, as required for the intended use. The vapour composition of the thus ignited mixture proved to be completely particle-free. The hydrogen chloride content in the vapour composition was below physiologically harmful levels at <50 ppm.

A temperature storage test was also carried out with the mixture at 110° C. over 400 h. The measured weight loss was less than 0.8%. The mixture is thus sufficiently stable.

Furthermore, a thermal shock test was carried out with tablets having different moisture contents. The tablets were first dried in a vacuum (<1 mbar) at 100° C. for 18 hours, then some of these were moistened again in a defined manner in a desiccator over 8 hours at 45% relative humidity. The $H_2O$ content of the dried tablets was 0.08%, the $H_2O$ content of the moistened tablets was 0.30%. The tablets were hermetically sealed in an aluminium container and subjected to thermal shock between −35° C. and +85° C. (56 cycles). Whereas the tablets with the increased moisture content had swelled up greatly after the test and were in some cases broken and consequently unusable for the intended purpose, the dry tablets exhibited no change to their mechanical properties.

EXAMPLE 2

51.5 g dry nitroguanidine, 43.0 g ammonium nitrate provided with 4% ZnO as phase stabiliser, 5.0 g dry ammonium perchlorate and 5.0 g soot were processed to form tablets in the manner described in example 1.

The tablets with a moisture content of 0.20% were subjected to thermal shock as described in example 1. On termination of this test, the tablets exhibited no change to their mechanical properties.

EXAMPLE 3

51.5 g dry nitroguanidine, 40.0 g dry ammonium nitrate, 8.0 g dry ammonium perchlorate, 2 g copper chromite and 0.5 g soot were processed to form tablets in the manner described in example 1 and ignited in a gas generator. The average rate of combustion at 200 bar was 23 mm/s.

EXAMPLE 4

51.5 g dry nitroguanidine, 40.0 g dry ammonium nitrate, 8.0 g dry ammonium perchlorate, 2 g iron oxide ($\gamma$-$Fe_2O_3$) and 0.5 g soot were processed in the manner described in example 1 and subjected to a temperature storage test at 110° C. The weight loss after 400 h was 0.13%.

We claim:

1. An azide-free, gas-producing mixture burning off in a particle-free manner for use in a gas generator for a safety device, in particular for a vehicle-occupant restraint system, with a total water content of the gas-producing mixture of at most 0.3%, consisting of:

a) an energy-rich fuel with an oxygen value of not less than −35%;

b) an oxidant mixture of ammonium nitrate and ammonium perchlorate, wherein the ammonium nitrate is contained in a proportion of 35 to 50 wt. %, and the ammonium perchlorate in a proportion of 3 to 10 wt. %, in each case relative to the total weight of the mixture;

c) optionally a phase-stabilising additive for the ammonium nitrate in a proportion of at most 5 wt. % relative to the weight of the ammonium nitrate;

d) 0 to 3 wt. % combustion moderators relative to the total weight of the mixture, and e) 0 to 5 wt. % processing aids relative to the total weight of the mixture.

2. The mixture according to claim 1, wherein the fuel is selected from the group comprising guanidine nitrate, nitroguanidine, triaminoguanidine nitrate, urea nitrate, nitrourea, pentaerythritol tetranitrate, nitrotriazolon, hexogen, octogen or mixtures thereof.

3. The mixture according to claim 2, wherein the fuel is guanidine nitrate and/or nitroguanidine.

4. The mixture according to claim 3, wherein the fuel is nitroguanidine.

5. The mixture according to claims 1, wherein the phase-stabilising additive is selected from the group comprising copper oxide, zinc oxide, a complex zinc compound or mixtures thereof.

6. The mixture according to claim 1, wherein the combustion moderator is soot.

7. The mixture according to claim 1, wherein the combustion moderator is a transition metal compound, preferably in a mixture with soot.

8. The mixture according to claim 7, wherein the transition-metal compound is selected from the group of transition-metal oxides, hydroxides, nitrates, carbonates and organo-metallic compounds of the transition metals.

9. The mixture according to claim 1, wherein the processing aids are selected from the group comprising the compression aids, flowing aids or lubricants.

10. The mixture according to claim 9, wherein the processing aids are selected from the group comprising polyethylene glycol, cellulose, methyl cellulose, graphite, wax, magnesium stearate, zinc stearate, boron nitride, talcum, bentonite and molybdenum sulfide and mixtures thereof.

11. The mixture according to claim 1, wherein the total water content of the mixture is 0.1 to 0.3 wt. % and the proportion of phase-stabilising additives for the ammonium nitrate is 3 to 5%.

12. The mixture according to claim 1, wherein the total water content of the mixture is less than 0.1 wt. % and the ammonium nitrate is free of phase-stabilising additives.

13. The mixture according to claim 1, wherein the mixture is composed of:

51.5 wt. % nitroguanidine 43.0 wt. % ammonium nitrate 5.0 wt. % ammonium perchlorate 0.5 wt. % soot.

* * * * *